US009003802B2

(12) United States Patent
Hernandez et al.

(10) Patent No.: US 9,003,802 B2
(45) Date of Patent: Apr. 14, 2015

(54) MULTIPOINT INJECTION DEVICE FOR A COMBUSTION CHAMBER OF A TURBINE ENGINE

(75) Inventors: Didier Hippolyte Hernandez, Quiers (FR); Emilie Lachaud, Villejuif (FR); Thomas Olivier Marie Noel, Vincennes (FR)

(73) Assignee: SNECMA, Paris (FR)

( * ) Notice: Subject to any disclaimer, the term of this patent is extended or adjusted under 35 U.S.C. 154(b) by 458 days.

(21) Appl. No.: 13/501,526

(22) PCT Filed: Oct. 6, 2010

(86) PCT No.: PCT/FR2010/052101

§ 371 (c)(1), (2), (4) Date: Apr. 12, 2012

(87) PCT Pub. No.: WO2011/045503

PCT Pub. Date: Apr. 21, 2011

(65) Prior Publication Data

US 2012/0198853 A1 Aug. 9, 2012

(30) Foreign Application Priority Data

Oct. 13, 2009 (FR) ..... 09 04906

(51) Int. Cl.

| | |
|---|---|
| ***F02C 1/00*** | (2006.01) |
| ***F02G 3/00*** | (2006.01) |
| ***F23R 3/28*** | (2006.01) |
| ***F23D 11/36*** | (2006.01) |
| ***F23R 3/34*** | (2006.01) |

(52) U.S. Cl.

CPC ..... *F23R 3/283* (2013.01); *F23D 11/36* (2013.01); *F23D 2900/00016* (2013.01); *F23R 3/343* (2013.01)

(58) Field of Classification Search

USPC ..... 60/737–748

See application file for complete search history.

(56) References Cited

U.S. PATENT DOCUMENTS

| | | | | |
|---|---|---|---|---|
| 4,754,600 | A | 7/1988 | Barbier et al. | |
| 7,788,927 | B2 * | 9/2010 | McMasters et al. | 60/739 |
| 2004/0250547 | A1 * | 12/2004 | Mancini et al. | 60/740 |
| 2007/0157616 | A1 | 7/2007 | Hernandez et al. | |

(Continued)

FOREIGN PATENT DOCUMENTS

| | | |
|---|---|---|
| EP | 0 239 462 | 9/1987 |
| EP | 1 806 536 | 7/2007 |
| EP | 2 026 002 | 2/2009 |

OTHER PUBLICATIONS

International Search Report issued on Feb. 10, 2011 in PCT/FR10/052101 filed on Oct. 6, 2010.

(Continued)

*Primary Examiner* — Craig Kim

(74) *Attorney, Agent, or Firm* — Oblon, McClelland, Maier & Neustadt, L.L.P.

(57) ABSTRACT

A fuel injector device for an annular combustion chamber of a turbine engine, including a pilot circuit feeding an injector and a multipoint circuit feeding injection orifices formed in a front face of an annular ring mounted in an annular chamber, together with a thermal insulation mechanism insulating the front face and including an annular cavity formed around the injection orifices between the front face of the annular ring and a front wall of the annular chamber and configured to be filled in operation with air or with coked fuel.

12 Claims, 3 Drawing Sheets

(56) References Cited

U.S. PATENT DOCUMENTS

| | | | | |
|---|---|---|---|---|
| 2009/0038312 | A1 | 2/2009 | Hernandez et al. | |
| 2009/0255260 | A1* | 10/2009 | McMasters et al. | 60/737 |
| 2012/0151929 | A1* | 6/2012 | Patel et al. | 60/740 |
| 2012/0180490 | A1* | 7/2012 | Takami et al. | 60/740 |

OTHER PUBLICATIONS

U.S. Appl. No. 13/501,385, filed Apr. 11, 2012, Hernandez, et al.

* cited by examiner

MULTIPOINT INJECTION DEVICE FOR A COMBUSTION CHAMBER OF A TURBINE ENGINE

BACKGROUND OF THE INVENTION

1. Field of the Invention

The present invention relates to a "multipoint" fuel injector device for an annular combustion chamber of a turbine engine such as an airplane turboprop or turbojet.

2. Description of the Related Art

In known manner, a turbine engine has an annular combustion chamber arranged at the outlet from a high-pressure compressor and provided with a plurality of fuel injector devices that are regularly distributed circumferentially at the inlet of the combustion chamber. A multipoint injector device comprises both a first venturi, within which a pilot injector is mounted centrally on the axis of the first venturi, which injector is fed continuously with fuel by a pilot circuit, and also a second venturi that is arranged coaxially around the first venturi. This second venturi has an annular chamber at its upstream end within which an annular ring is mounted, the ring being fed with fuel by a multipoint circuit. The ring has fuel injection orifices formed in a front face and aligned with orifices in a front face of the annular chamber so as to eject the fuel downstream and towards the outside of the second venturi.

The pilot circuit delivers a continuous flow of fuel at a rate that is optimized for low speeds, and the multipoint circuit delivers fuel at an intermittent rate that is optimized for high speeds.

Nevertheless, under the effect of the high temperatures due to the radiation from the flame in the combustion chamber, using an intermittent multipoint circuit presents the major drawback of giving rise to any fuel that stagnates inside the multipoint circuit clogging or coking when the multipoint circuit is switched off. These phenomena can give rise to coke being formed in the ring and in the fuel injection orifices of the multipoint circuit, thereby adversely affecting the spraying of fuel from the multipoint circuit, and thus affecting the operation of the combustion chamber.

In order to reduce this risk of coking, it is known from document EP 2 026 002 in the name of the Applicant to make use of the fuel pilot circuit to cool the multipoint circuit so as to reduce the formation of coke therein, by using two annular channels for passing fuel that are formed in the annular chamber radially inside and outside the annular ring, these two channels having their outlets connected to the pilot injector.

Nevertheless, such a configuration does not achieve a satisfactory reduction in the risk of coking for the fuel over the front face of the annular chamber, since said fuel remains strongly exposed to the thermal radiation generated by the combustion of fuel downstream therefrom.

BRIEF SUMMARY OF THE INVENTION

A particular object of the invention is to provide a solution to this problem that is simple, effective, and inexpensive.

To this end, the invention provides a fuel injector device for an annular combustion chamber of a turbine engine, the device comprising a pilot circuit continuously feeding an injector leading into a first venturi and a multipoint circuit intermittently feeding injection orifices formed in a front face of an annular ring mounted in an annular chamber formed at the upstream end of a second venturi coaxially surrounding the first venturi, the device being characterized in that it includes thermal insulation means for insulating the front face of the annular ring, said means comprising an annular cavity formed around the injection orifices between the front face of the annular ring and a front wall of the annular chamber, and being designed to be filled in operation with air or with coked fuel.

Incorporating thermal insulation means formed by an insulating annular cavity interposed between the front face of the ring and a downstream wall of the annular chamber serves to protect the injection orifices of the ring so as to avoid them becoming coked, thereby guaranteeing proper operation of the multipoint circuit.

The annular cavity may be filled with air or with coked fuel, thereby providing good thermal insulation for the multipoint annular ring and its fuel injection orifices relative to the thermal radiation from combustion of the fuel.

Preferably, the device also includes a cooling circuit for cooling the annular ring by causing the fuel of the pilot circuit to flow in an inner annular channel formed between inner cylindrical walls of the ring and of the annular chamber, and in an outer annular channel formed between outer cylindrical walls of the ring and of the annular chamber.

Advantageously, one of the inner and outer channels communicates with the above-mentioned annular cavity, the other one of the inner and outer channels being isolated from said cavity, thereby enabling the front annular cavity to be filled with fuel that becomes coked under the effect of the thermal radiation from combustion of the fuel.

According to another characteristic of the invention, the radially inner or outer periphery of the front face of the annular ring includes an annular rim having a downstream edge that co-operates with the front wall of the chamber to define an annular passage for communication between the above-mentioned annular cavity and one of the inner and outer channels of the cooling circuit.

This annular passage enables fuel to reach the inside of the front cavity and become coked under the effect of the thermal radiation in order to isolate the injection orifices of the ring.

According to yet another characteristic of the invention, the radially outer periphery of the front face of the ring bears radially against the outer cylindrical wall of the chamber in order to center the ring in the chamber.

In a first embodiment of the invention, each injection orifice in the ring is formed in a stud projecting from the front face of the ring, these studs being inserted into abutment in respective cavities of corresponding projections formed on the front face of the annular chamber. Such positioning in abutment serves to guarantee that the ring is properly mounted axially in the annular chamber.

Each cavity in a projection leads to the outside of the annular chamber via a hole in alignment with the injection orifice of the corresponding stud, the hole having a diameter that is greater than the diameter of the injection orifice, thereby enabling the zone in which drops of fuel become coked to be offset away from the injection orifices in the studs and towards the holes in the annular chamber.

In a variant embodiment of the invention, the injection orifices are formed in cylindrical pins fastened in holes in the front face of the annular ring, the pins projecting beyond said front face and forming positioning and centering means in the annular chamber.

This configuration is particularly advantageous when the space available inside the chamber is small and does not enable studs and projections to be made as in the above embodiment.

The injection orifice in each pin has a downstream end of greater diameter in order to avoid injection orifices coking while the multipoint circuit is stopped.

The ring is axially positioned in the annular chamber by an annular rim formed at the radially inner end of the downstream wall of the ring, this rim coming into abutment against the front wall of the annular chamber.

The invention also provides an annular combustion chamber for a turbine engine, the combustion chamber including at least one fuel injector device of the above-described type.

BRIEF DESCRIPTION OF THE SEVERAL VIEWS OF THE DRAWINGS

The invention can be understood and other details, advantages, and characteristics of the invention appear on reading the following description made by way of non-limiting example with reference to the accompanying drawings, in which.

DETAILED DESCRIPTION OF THE INVENTION

Figure 1:
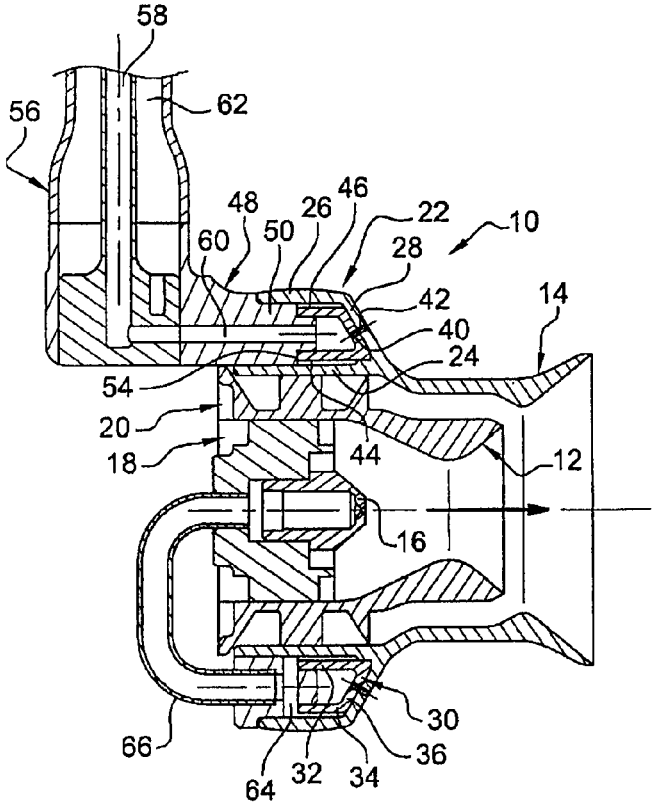
FIG. 1 is a fragmentary diagrammatic axial section view of a prior art multipoint fuel injector device.
Figure 2:
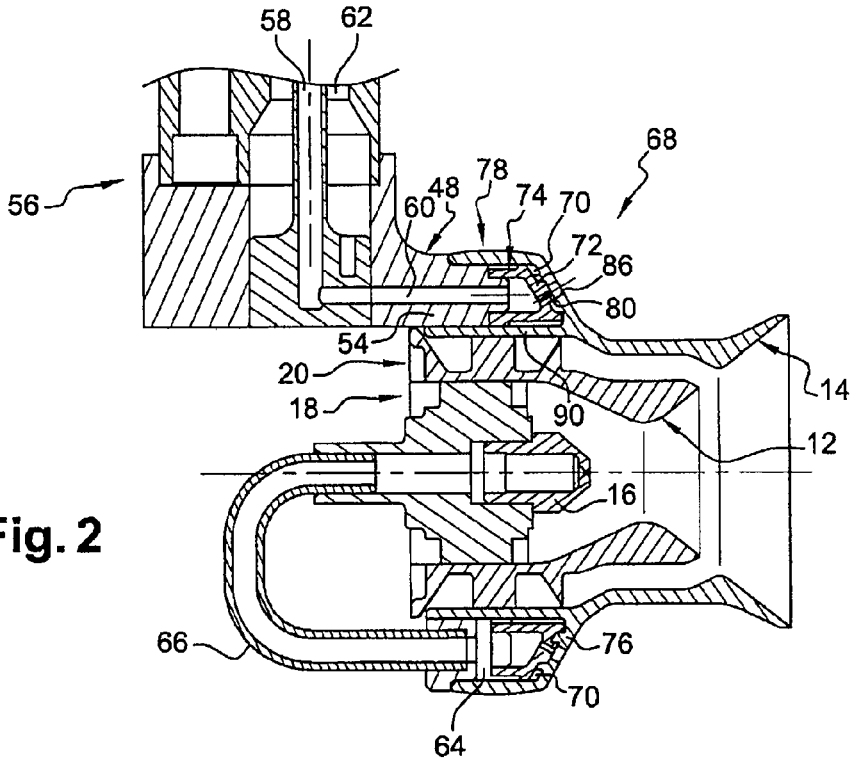
FIG. 2 is a fragmentary diagrammatic axial section view of a multipoint fuel injector device of the invention.
Figure 3:
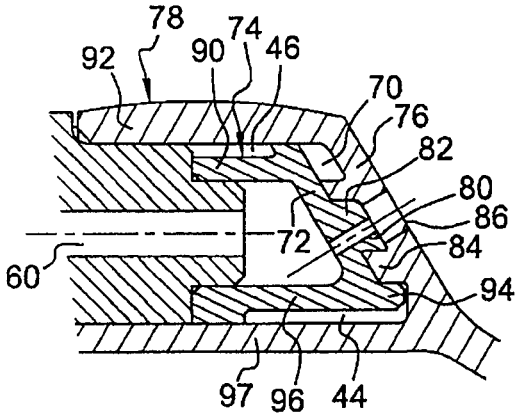
FIG. 3 is a diagrammatic axial section view on a larger scale of the ring and the annular chamber of the FIG. 2 injector device, the section being on a plane containing a multipoint injection orifice.
Figure 4:
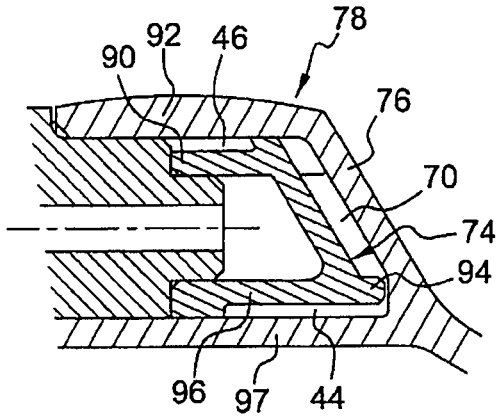
FIG. 4 is a diagrammatic axial section view on a larger scale of the ring and the annular chamber of the FIG. 2 injector device on a plane lying between two multipoint injection orifices.
Figure 5:
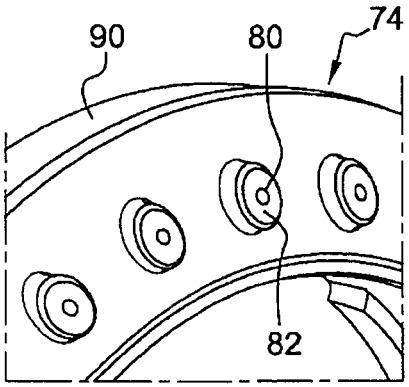
FIG. 5 is a diagrammatic perspective view of the front face of the annular ring of the FIG. 2 injector device.
Figure 6:
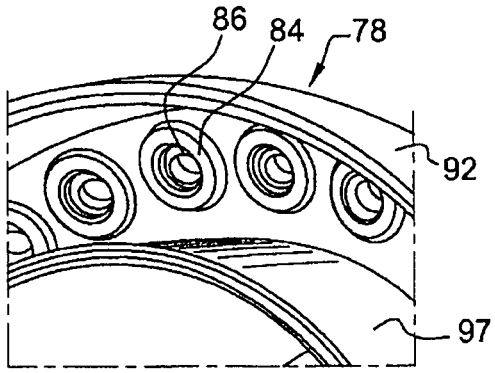
FIG. 6 is a diagrammatic perspective view of the annular chamber of the FIG. 2 injector device.

Reference is made initially to FIG. 1, which shows an injector device 10 of the prior art having two fuel injector systems, one of which is a pilot system that operates continuously, and the other of which is a multipoint system that operates intermittently. The device is for mounting in an opening in an end wall of an annular combustion chamber of a turbine engine, which combustion chamber is fed with air by an upstream high-pressure compressor and delivers combustion gas to a turbine mounted downstream.

The device comprises a first venturi 12 and a second venturi 14 arranged coaxially with the first venturi 12 mounted inside the second venturi 14. A pilot injector 16 is mounted inside a first stage of swirlers 18 inserted axially inside the first venturi 12. A second stage of swirlers 20 is formed at the upstream end of the first venturi 12 and radially on the outside thereof so as to extend between the first and second venturies 12 and 14.

The second venturi 14 has an annular chamber 22 formed by two cylindrical walls, a radially inner wall 24 and a radially outer wall 26 that are connected together by a frustoconical downstream wall 28 that converges downstream. An annular ring 30 also has two cylindrical walls, a radially inner wall 32 and a radially outer wall 34 that are connected together by a frustoconical downstream wall 36 that converges downstream, which ring is mounted inside the annular chamber 22 so that the downstream walls 28 and 36 of the annular chamber 22 and of the annular ring 30 come into contact.

The annular ring 30 and the annular chamber 22 have respective annular openings at their upstream ends. The cylindrical walls 24 and 26 of the annular chamber 22 project upstream from the upstream ends of the cylindrical walls 32 and 34 of the annular ring 30.

The downstream wall 36 of the annular ring 30 has injection orifices 40 that are regularly distributed circumferentially and that lead into corresponding orifices 42 in the downstream wall 28 of the annular chamber 22. The orifices 40 and 42 of the annular chamber 22 and of the annular ring 30 are identical in diameter.

An inner annular channel 44 for passing fuel is defined between the inner cylindrical walls 24 and 34 of the annular ring 30 and of the annular chamber 22. In similar manner, an outer annular channel 46 for passing fuel is defined between the outer cylindrical walls 26 and 34 of the annular ring 30 and of the annular chamber 22.

The injector device comprises a body 48 for feeding fuel having a downstream portion that is annular with a cylindrical duct 50 engaged axially in leaktight manner between the inner and outer cylindrical walls 24 and 26 of the annular chamber 22 and leading in sealed manner to between the inner and outer cylindrical walls 32 and 34 of the annular ring 30. The duct 50 has a radial shoulder 54 that comes into abutment against the upstream ends of the inner and outer cylindrical walls 32 and 34 of the annular ring 30.

This sealed assembly of the body 48 serves to guarantee that the inner and outer annular channels 44 and 46 are sealed from the annular space formed inside the annular ring 30.

A fuel feed arm 56 is connected to the body 48 and comprises two coaxial ducts, namely a central duct 58 that feeds a channel 60 of the body 48 leading downstream to the inside of the annular ring 30, and an outer duct 62 formed around the central duct 58 and feeding distinct channels (not shown) leading to the inner and outer annular channels 44 and 46, respectively.

The body 48 has a fuel collector cavity 64 formed diametrically opposite from the fuel feed arm 56 at the upstream ends of the cylindrical walls 32 and 34 of the annular ring 30 so that the inner and outer annular channels 44 and 46 communicate with the collector cavity 64. A duct 66 is connected at one end to the pilot injector 16 and at the other end leads into the collector cavity 64.

In operation, the central duct 58 of the arm 56 feeds the channel 60 of the body 48 with fuel, the fuel then flowing in the annular ring 30 and being injected into the combustion chamber downstream via the orifices 40, 42 in the ring 30 and in the chamber 22.

The outer duct 62 of the arm 56 feeds the channels in the body 48 that lead into the inner and outer annular channels 44 and 46, the fuel then passing into the collector cavity 64 in order to feed the pilot injector 16 via the duct 66.

The pilot circuit operates continuously, while the multipoint circuit operates intermittently during specific stages of flight such as takeoffs that require extra power.

During operation of the turbine engine, hot air (at about 600° C.) coming from the high-pressure compressor flows inside the first venturi 12, through the first radial swirler 18, and the air also flows inside the second radial swirler 20, between the first and second venturies 12 and 14.

The inner and outer annular channels 44 and 46 through which the fuel feeding the pilot injector flows continuously form a cooling circuit radially outside and inside the annular ring 30, thereby avoiding fuel coking inside the ring 30 as a result of the thermal radiation of the combustion, with this occurring during stages of flight in which the multipoint circuit is not in operation.

As mentioned above, the downstream face 28 of the annular chamber 22 is directly subjected to the thermal radiation of the combustion, and this can lead to fuel coking in the injection orifices 40 and 42 of the ring 30 and of the annular chamber 22 during stages of flight in which the multipoint circuit is not in use.

The invention provides a solution to this problem by incorporating thermal insulation means in the injector device 68 for insulating the front wall of the multipoint annular ring.

These thermal insulation means comprise an insulating annular cavity 70 formed between the front face 72 of the annular ring 74 and the downstream wall 76 of the annular chamber 78. This cavity 70 extends between the injection orifices 80 so as to provide thermal insulation as close as possible to them. This serves to diminish any risk of fuel coking in the fuel injection orifices 80 so as to guarantee proper operation of the multipoint circuit.

In a first embodiment of the invention shown in FIGS. 2 to 6, the front face 72 of the annular ring 74 has a plurality of studs 82 projecting regularly around the ring 74, each including an injection orifice 80. These studs 82 are inserted in cavities of projections 84 on the upstream face of the downstream wall 76 of the annular chamber 78. The studs 82 are engaged inside the cavities of the projections so as to come into abutment against the downstream wall 76 of the annular chamber 78, thereby ensuring that the ring 74 is correctly positioned axially within the annular chamber 78.

The downstream wall 76 of the annular chamber 78 includes holes 86 (see FIG. 3), each leading from an upstream end in the cavity of a projection 84 to the outside of the second venturi at a downstream end, each hole 86 being in alignment with an injection orifice 80 of the ring 74 and having a diameter that is greater than the diameter of the injection orifice 80 so as to offset the zone where drops of fuel become coked towards the holes 86 in the annular chamber 78.

The studs 82 are substantially cylindrical in shape and they are brazed to the insides of the cavities in the projections 84 so as to provide sealing between the pilot circuit and the multipoint circuit. It is possible to check that the brazing has been performed correctly by visual inspection through the holes 86 in the downstream wall 76 of the annular chamber 78, because these holes 86 present a diameter that is greater than the diameter of the injection orifices 80.

The radially outer periphery of the front face 72 of the ring 74 extends radially to the outside of its outer cylindrical wall 90 and bears radially against the outer cylindrical wall 92 of the annular chamber 78 so as to center the ring 74 in the annular chamber 78. The radially inner periphery of the front face 72 has an annular rim 94 extending downstream from the front face 72 in line with the inner cylindrical wall 96. The downstream end of this annular rim 94 forms an annular passage for fuel between the inner annular channel 44 and the front annular cavity 70.

The device of the invention also includes a cooling circuit formed both by an inner annular channel 44 defined by the inner cylindrical walls 96 and 97 of the ring 74 and of the annular chamber 78, and also by an outer annular channel 46 defined by the outer cylindrical walls 90 and 92 of the ring 74 and of the annular chamber 78.

In this embodiment, the outer annular channel 46 is insulated from the front cavity by the radially outer periphery of the front face 72 of the ring 74 which may optionally be brazed to the outer cylindrical wall 92 of the annular chamber 78 so as to provide an optional sealed connection.

Figure 7:
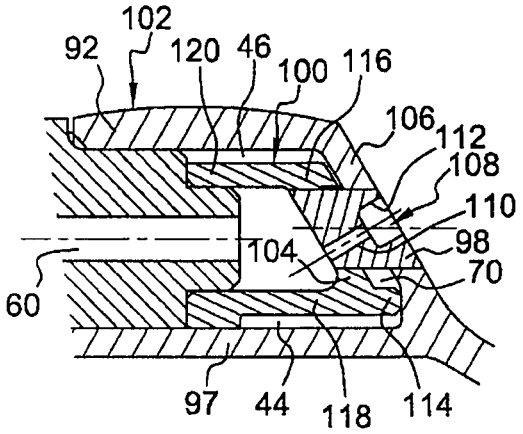
FIG. 7 is a diagrammatic axial section view of a ring and an annular chamber of a device in a variant of the invention and on a plane containing a multipoint injection orifice.
Figure 8:
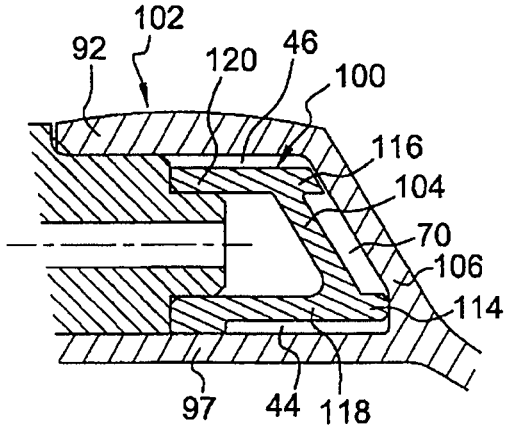
FIG. 8 is a diagrammatic axial section view similar to that of FIG. 7 but on a plane passing between two multipoint injection orifices.
Figure 9:
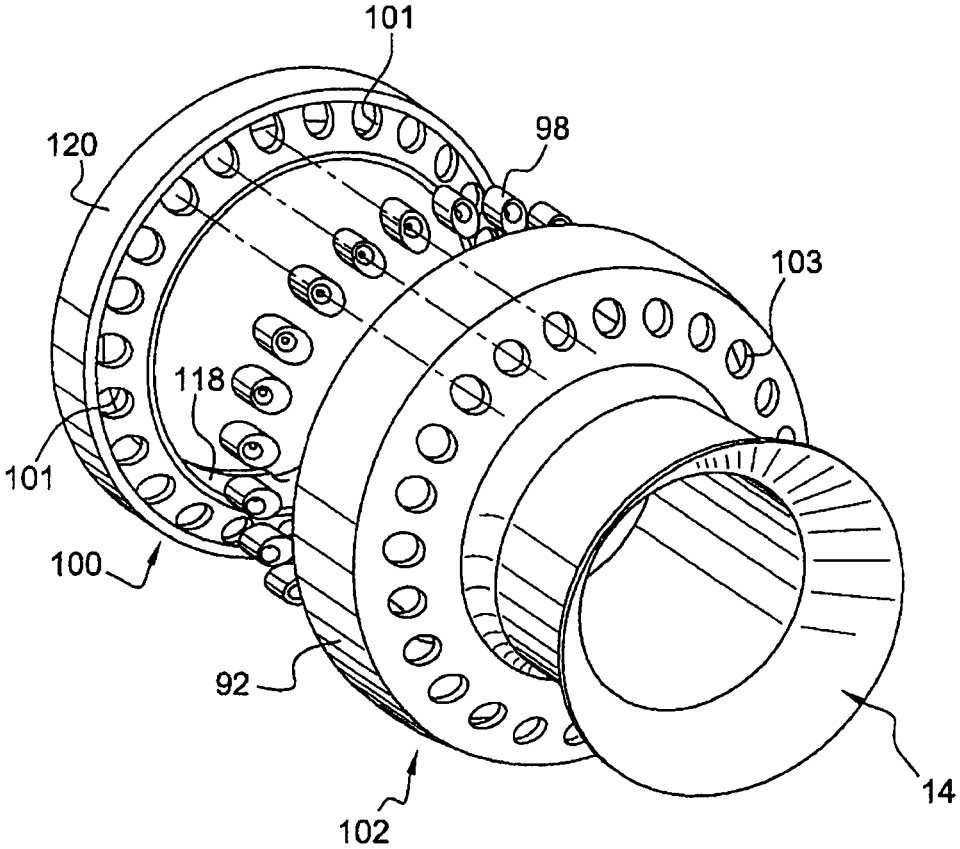
FIG. 9 is an exploded perspective view of the injector device of FIGS. 7 and 8.

In a variant embodiment of the invention shown in FIGS. 7 to 9, the device has a plurality of pins 98 for centering the ring 100 in the annular chamber 102, these pins 98 being regularly distributed around the ring 100 and being mounted axially in holes 101 in the front wall 104 of the ring 100 and in corresponding holes 103 in the annular chamber 102. The upstream and downstream faces of the pins are substantially parallel to the frustoconical walls 104 and 106 of the ring 100 and of the annular chamber 102. The axial size of each pin is such that its upstream and downstream faces are respectively in alignment with the upstream face of the front wall 104 of the ring 100 and with the downstream face of the downstream wall 106 of the annular chamber 102.

Each pin 98 has an injection orifice 108 formed by a first hole 110 leading from the inside of the annular ring 100 at an upstream end into a second hole 112 of greater diameter at a downstream end, which hole leads to the outside of the second venturi 14. The holes 110 and 112 are in alignment along respective straight lines perpendicular to the frustoconical downstream walls 104, 106 of the ring 100 and of the annular chamber 102.

As in the above-described embodiment, the greater diameter of the holes 112 in the annular chamber compared with the diameters of the injection orifices 110 enables coking of the injection orifices 110 to be limited.

The radially inner and outer peripheries of the front wall 104 of the ring 100 have inner and outer annular rims 114 and 116, respectively, which rims extend downstream from the front wall 104 in line with the inner and outer cylindrical walls 118 and 120, respectively. The inner annular rim 114 is in contact with the downstream wall 106 of the chamber 102 so as to provide an abutment for axially positioning the ring 100 in the annular chamber 102, while the outer annular rim 116 co-operates with the front wall 106 of the chamber 102 to define an annular passage providing communication between the outer annular cavity 46 of the pilot circuit and the front cavity 70 for providing thermal insulation.

The ring 100, the chamber 102, and the pins 98 are assembled together as follows: the annular ring 100 is mounted in axial abutment inside the annular chamber 102 by using the inner annular rim 114 of the ring 100, and it is positioned angularly in such a manner that the holes 101 of the ring 100 are in alignment with the holes 103 of the annular chamber 102. The centering pins 98 are then mounted in the holes 101 and 103 of the ring 100 and of the chamber 102, and the pins 98 are brazed in these holes so as to provide sealing between the pilot circuit and the multipoint circuit. The upstream and downstream faces of the pins 98 are reworked by machining. Finally, the holes 110 and 112 are formed in each of the pins 98, this operation being performed after the brazing and machining operations to avoid any partial shutting of the holes 110, 112 in the pins 98.

This configuration with centering pins is found to be particularly advantageous in multipoint injector configurations where the space inside the chamber is small and does not enable studs and projections to be accommodated.

In the above-described embodiments, the front annular cavity is in communication with one of the inner or outer channels (FIG. 4 or FIG. 8) of the cooling circuit in order to feed the front annular cavity 70 with fuel while the turbine engine is in operation. In these configurations, the fuel present inside the front cavity cokes under the effect of the thermal radiation, thereby forming thermal insulation that protects the multipoint annular ring.

In other embodiments that are not shown in the drawings, it is possible to insulate the front cavity 70 from the inner and outer annular channels 44 and 46, the cavity then being filled with air that forms thermal insulation for the front face 72 of the annular ring 74, 100.

The invention claimed is:

1. A fuel injector device for an annular combustion chamber of a turbine engine, the device comprising:

a pilot circuit continuously feeding an injector leading into a first venturi;

a multipoint circuit intermittently feeding injection orifices formed in a downstream face of an annular ring mounted in an annular chamber formed at the upstream end of a second venturi coaxially surrounding the first venturi; and thermal insulation means for insulating the downstream face of the annular ring, the thermal insulation means comprising an annular cavity formed around the injection orifices between the downstream face of the annular ring and a downstream wall of the annular chamber and configured to be filled in operation with air or with coked fuel, the downstream face of the annular ring and the downstream wall of the annular chamber extending at least partially in a radial direction.

2. A device according to claim 1, further comprising a cooling circuit for cooling the annular ring by causing fuel of the pilot circuit to flow in an inner annular channel formed between inner cylindrical walls of the annular ring and of the annular chamber, and in an outer annular channel formed between outer cylindrical walls of the annular ring and of the annular chamber.

3. A device according to claim 2, wherein one of the inner and outer channels communicates with the annular cavity, the other one of the inner and outer channels being isolated from the annular cavity.

4. A device according to claim 3, wherein the radially inner or outer periphery of the downstream face of the annular ring includes an annular rim having a downstream edge that cooperates with the downstream wall of the annular chamber to define an annular passage for communication between the annular cavity and one of the inner and outer channels of the cooling circuit.

5. A device according to claim 2, wherein the radially outer periphery of the downstream face of the annular ring bears radially against the outer cylindrical wall of the chamber to center the annular ring in the chamber.

6. A device according to claim 1, wherein each injection orifice in the annular ring is formed in a stud projecting from the downstream face of the annular ring, each studs being inserted into abutment in respective cavities of corresponding projections formed on the downstream face of the annular chamber.

7. A device according to claim 6, wherein each cavity in a projection leads to the outside of the annular chamber via a hole in alignment with the injection orifice of the corresponding stud, the hole having a diameter that is greater than the diameter of the injection orifice.

8. A device according to claim 1, wherein the injection orifices are formed in cylindrical pins fastened in holes in the downstream face of the annular ring, the pins projecting beyond the downstream face and forming positioning and centering means in the annular chamber.

9. A device according to claim 8, wherein the injection orifice in each pin has a downstream end of greater diameter.

10. A device according to claim 8, wherein the radially inner end of the downstream face of the annular ring includes an annular rim for axial positioning in the annular chamber.

11. An annular combustion chamber for a turbine engine, the combustion chamber comprising at least one fuel injector device according to claim 1.

12. A device according to claim 1, wherein an upstream end of the annular ring abuts a radial shoulder of a duct.

* * * * *